US006646657B1

(12) United States Patent
Rouser

(10) Patent No.: US 6,646,657 B1
(45) Date of Patent: Nov. 11, 2003

(54) SYSTEMS AND METHODS FOR PROCESSING DATA

(75) Inventor: Lavi Vonielle Rouser, Mount Prospect, IL (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/450,027

(22) Filed: Nov. 29, 1999

(51) Int. Cl.[7] ..... G09G 5/00
(52) U.S. Cl. ..... 345/741; 345/862
(58) Field of Search ..... 345/741, 742, 345/743, 807, 808, 867, 868

(56) References Cited

U.S. PATENT DOCUMENTS

| | | | | |
|---|---|---|---|---|
| 5,913,040 A | * | 6/1999 | Rakavy et al. | 709/200 |
| 6,266,775 B1 | * | 7/2001 | Kamba | 713/202 |
| 6,288,715 B1 | * | 9/2001 | Bain et al. | 345/808 |

* cited by examiner

*Primary Examiner*—Cao (Kevin) Nguyen
(74) *Attorney, Agent, or Firm*—Oliff & Berridge, PLC

(57) ABSTRACT

In a computer system comprising a screen, a screen saver determines if a predetermined time period lapses and, saves a screen when the predetermined time period has elapsed. When the screen saver runs, messages can be left, and, when a user is identified, he can gain access to the left messages.

11 Claims, 10 Drawing Sheets

SYSTEMS AND METHODS FOR PROCESSING DATA

BACKGROUND OF THE INVENTION

1. Field of Invention

This invention relates to data processing systems and methods.

2. Description of Related Art

When the same image is displayed by a computer screen during a long period of time, the front surface of the screen can deteriorate. Moreover, when a user is not working with his or her computer, it is not necessary that the screen of his computer continues displaying data and wasting electrical power.

Screen savers are software that automatically switch the image displayed by a computer screen when no input events, such as keyboard presses, mouse movement or mouse button clicks, are received after a predetermined amount of time. The new image is a moving picture. Thus, the screen savers save electrical power and increase the screen component's life.

To avoid an unauthorized person from accessing a user's confidential information when a user is away from his computer area, screen savers are often equipped with authentication routines. When a user touches the mouse or the keyboard of the computer, the user is requested to enter a security code. If the security code is recognized, the user can use the computer. Otherwise, the use of the computer and the access to the files and resources of the computer is denied.

SUMMARY OF THE INVENTION

When a visitor enters the working area of the user, if the user is not there, the visitor may want to leave a message to the user. Sometimes, the message can contain confidential information that neither the visitor or the user wants to leave accessible to a third party.

This invention provides systems and methods that permit a visitor to leave an electronic message in the user's computer even when the screen saver denies access to the user's files, data and other computer resources.

These and other features and advantages of this invention are described in or are apparent from the following detailed description of the systems and methods according to this invention.

BRIEF DESCRIPTION OF THE DRAWINGS

Various exemplary embodiments of this invention will be described in detail, with reference to the accompanying drawings, wherein.

DETAILED DESCRIPTION OF PREFERRED EMBODIMENTS

Figure 1:
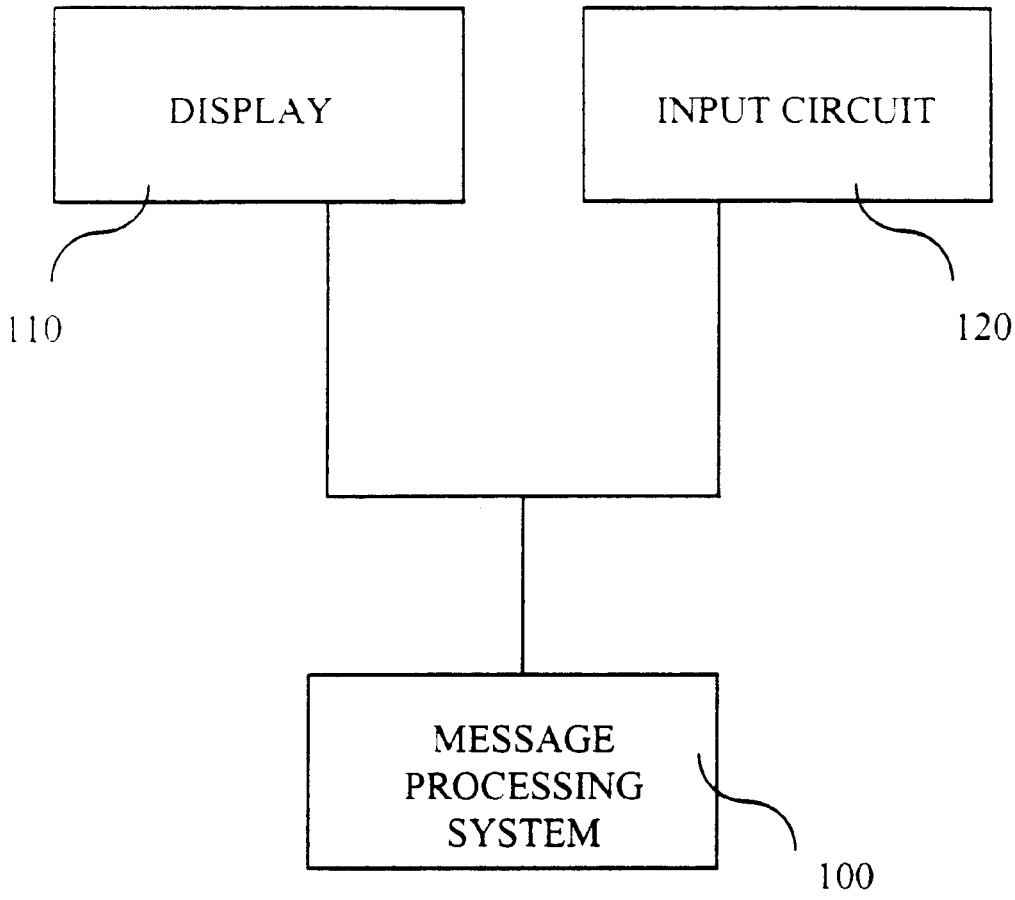
FIG. 1 is a functional block diagram outlining a first exemplary embodiment of a data processing system according to this invention.

FIG. 1 is a functional block diagram outlining a first exemplary embodiment of a data processing system according to this invention. As shown in FIG. 1, a data processing system 100 is connected to a display 110 and an input circuit 120.

The data processing system 100 can be a computer or any other known or later developed system capable of processing data and driving a display and receiving data from an input circuit 120. The display 110 can be a cathode ray tube display, a liquid crystal display or any other known or later developed system capable of displaying data. The input circuit 120 can be one or more of a keyboard a mouse, a touch screen, a touch pad, a microphone or any other known or later developed circuit capable of inputting data.

In operation, the data processing system 100 is first in a normal mode in which the user can gain access to all the processing functions that the data processing system 100 is able to perform. After each data input from the input circuit 120, the data processing system 100 measures the elapsed time period since the last data input. The data processing system 100 then determines if this time period is longer than a predetermined time period. If so, the data processing system 100 switches into a screen saver mode. In the screen saver mode, the image displayed by the display 110 is a moving image so that the display components do not deteriorate.

In the screen saver mode, when data is input through the input circuit 120, the data processing system 100 drives the display 110 to display a menu to invite the person who used the input circuit 120 to select between at least the functions of leaving at least one new message, viewing any messages that may have been left, or accessing the normal mode to use the processing functions of the data processing system 100.

When the person chooses to leave a message, this person is considered to be a visitor by the data processing system 100. Thus, the visitor is allowed to leave a message using the input circuit 120. The data processing system 100 stores the visitor's message and returns to the moving image to protect the display components.

When the person chooses to view the messages left, the data processing system 100 authenticates this person, i.e., determines if this person is authorized to gain access to any messages that may have been left and to the normal mode. If the person is not authorized, the person does not gain access to the normal mode or to the message(s) left during the screen saver mode.

When the user is authenticated, the data processing system 100 displays any messages that may have been left. Then, the data processing system 100 returns to the normal mode.

Figure 2:
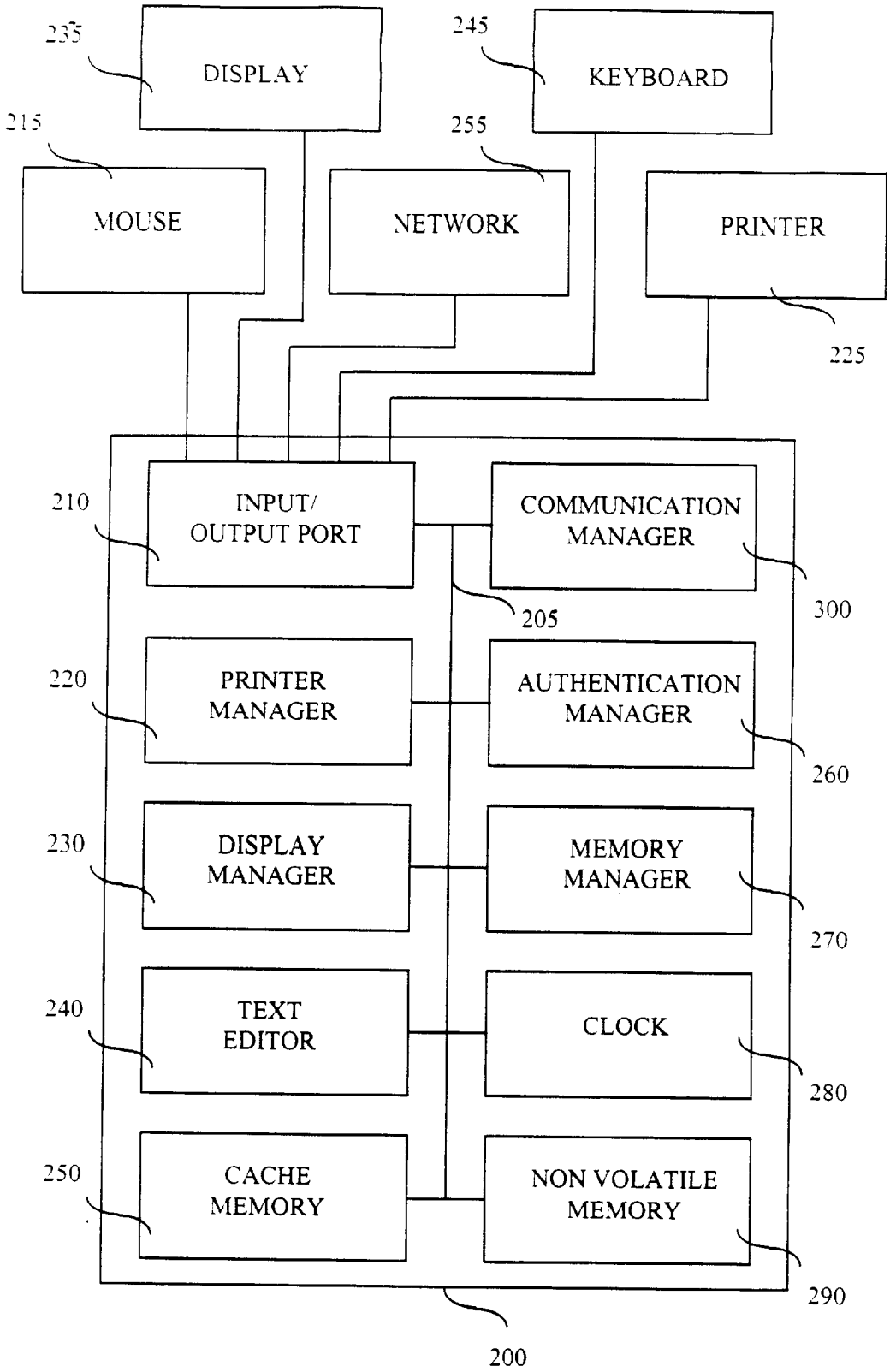
FIG. 2 is a functional block diagram outlining a second exemplary embodiment of the data processing systems according to this invention.

FIG. 2 is a functional block diagram outlining a second exemplary embodiment of the data processing systems according to this invention. As shown in FIG. 2, a data processing system 200 comprises at least some of an input/output port 210, a printer manager 220, a display manager 230, a text editor 240, a cache memory 250, an authentication manager 260, a memory manager 270, a clock circuit 280, a non-volatile memory 290 and a communication manager 300, connected together by a data/control bus 205.

The input/output port 210 is connected to one or more of a mouse 215, a printer 225, a display 235, a keyboard 245 and a network 255. The input/output port 210 receives data from one or more of the mouse 215, the keyboard 245 and the network 255 and transmits the received data to the data/control bus 205. The input/output port 210 also receives data from the data/control bus 205 and transmits that data to at least one of the printer 225, the display 235, the keyboard 245 and the network 255.

The printer manager 220 drives the printer 225. For example, the printer manager 220 can drive the printer 225 to print messages from the text editor 240. The display manager 230 drives the display 235. The text editor 240 allows the user to compose and edit messages. The cache memory 250 is a memory that stores messages composed using the text editor 240. The authentication manager 260 authenticates the current user, i.e., determines if the current user is authorized to gain access to the messages stored in the cache memory 250 or to the data and software stored in the non-volatile memory 290. The memory manager 270 manages reading data from and writing data to both the cache memory and the non-volatile memory 290. The clock circuit 280 provides clock signals. The non-volatile memory 290 stores software and data used by the data processing system 200. For example, the non-volatile memory 290 stores word processing software and communication software. The communication manager 300 drives the transmission of data to and the reception of data from the network 255.

In operation, the data processing system 200 is in a normal mode in which the user can gain access to any data and/or software stored in the non-volatile memory 290. After each data input from the mouse 215, the keyboard 245, the network 255 or any other input device connected to the input/output port 210, the display manager 230 measures the elapsed time period since the last data input. The display manager 230 then determines if this time period is longer than a predetermined time period. If so, the display manager 230 switches the data processing system 200 into a screen saver mode. In the screen saver mode, the image displayed by the display 235 is a moving image so that the display components do not deteriorate.

In the screen saver mode, the display manager 230 displays an image that represents the number of messages left in the cache memory 250. When the mouse 215, the keyboard 245 or any other input device connected to the input/output port 210 are used by a current user, such as a visitor to the owner of the data processing system 200, the display manager 230 displays a menu on the display 235 to invite the current user who used that input device to select between leaving at least one new message, viewing the message(s) left, exiting the screen saver mode, or returning to the screen saver mode.

When the current user chooses to leave a message, the current user is considered to be a visitor by the data processing system 200. Then, the text editor 240 allows the visitor to compose and edit a message. The memory manager 270 stores the visitor's message in the cache memory 250 and returns to the screen saver mode to again display the moving image to protect the display components.

When the current user chooses either to view the message (s) left or to exit the screen saver mode, the authentication manager 260 authenticates that the current user is an authorized user of the data processing system 200. If the current user is not authorized, the current user is not allowed access to the normal mode or to any messages that may have been left while the data processing system 200 was in the screen saver mode.

Once the current user is authenticated, if the user selected to exit the screen saver mode, the display manager 230 switches the data processing system 200 to the normal mode. In contrast, once the user is authenticated, if the current user selected to view any messages that may have been left, the display manger 230 displays any messages that were left and a menu of possible processing to be applied to each such message. For example, the menu allows the user, for each message, to print the message, to forward the message, to delete the message, or to save the message in the non-volatile memory 290.

For example, if the user selected printing a message, the memory manager 270 transfers data corresponding to the message from the cache memory 250 to the printer manager 230 and the message is printed by the printer 225. If the user selected forwarding the message, the user is requested to select a destination that can be reached through the network 255. In response, the memory manager 270 transfers data corresponding to the message from the cache memory 250 to the communication manager 300. The message is then transmitted by the communication manager 300 to the selected destination. If the user selected deleting the message, the memory manager 270 deletes the data corresponding to the message from the cache memory 250.

If the user selected saving the message, the user is requested to enter a file name. In response, the memory manger 270 creates a file having the entered name in the non-volatile memory 290. Next, the memory manager 270 transfers the data corresponding to the message from the cache memory 250 to the newly created file. Then, the user can view and process another message or exit the screen saver mode.

Figure 3:
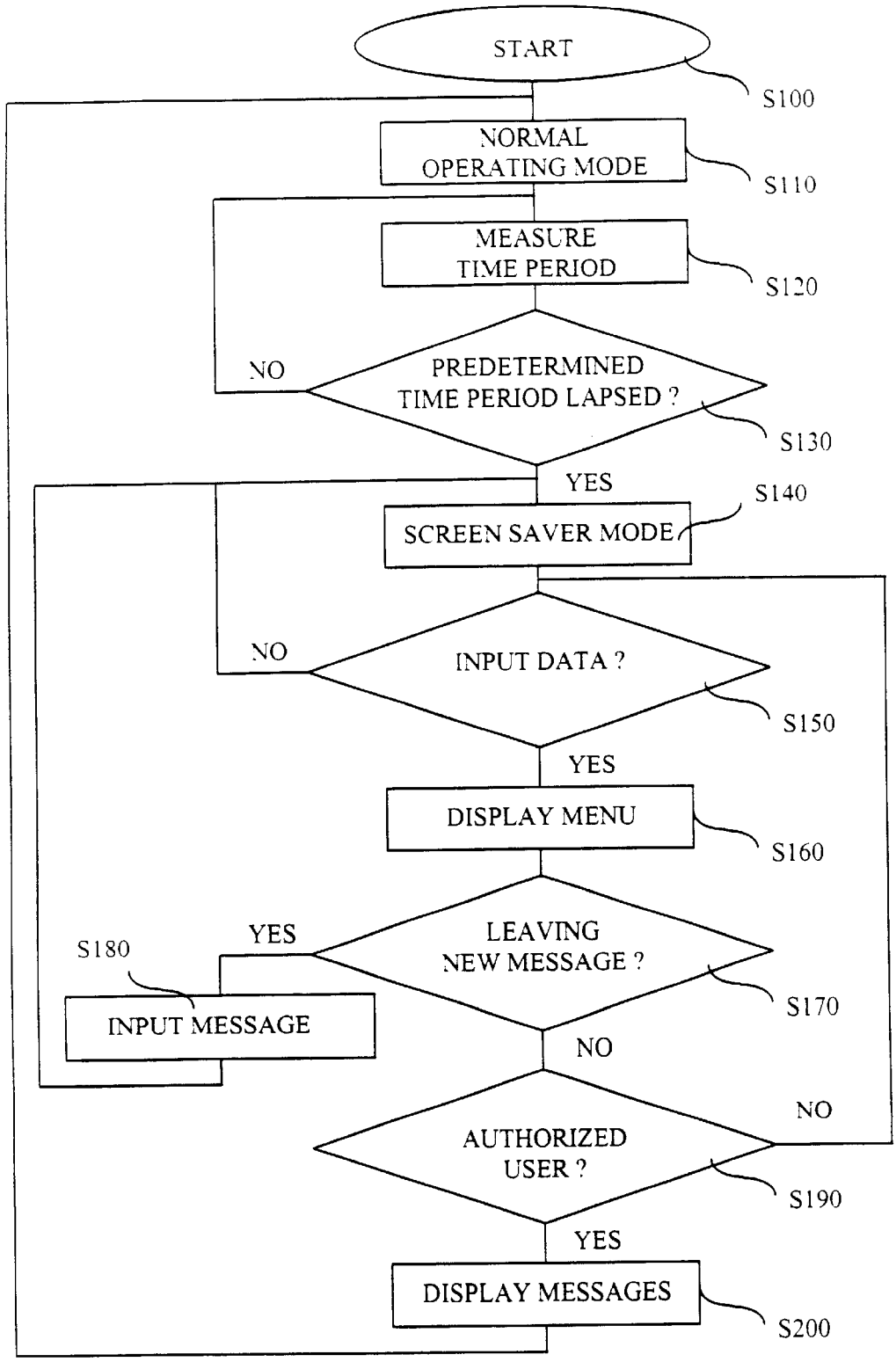
FIG. 3 is a flowchart outlining a first exemplary embodiment of a data processing method according to this invention.

FIG. 3 is a flowchart outlining a first exemplary embodiment of a data processing method according to this invention. Beginning in step S100, control continues to step S110, where the data processing system is placed into a normal operating mode in which the user can gain access to all the available functions provided by the data processing system. Next, in step S120, the elapsed time period since the last data input is measured. Then, in step S130, a determination is made whether this time period is longer than a predetermined time period. If so, control continues to step S140. Otherwise, control returns to step S120.

In step S140, the data processing system is placed into a screen saver mode. In the screen saver mode, a moving image is displayed. Next, in step S150, a determination is made whether an input to the data processing system has been received. If so, control continues to step S160. Otherwise, control returns to step S140.

In step S160, a menu is displayed on a display device of the data processing system to a current user. The menu invites the current user who generated the input to the data processing system to select between two or more functions. These functions can include, for example, leaving a new message, viewing the messages left, entering the normal mode or returning to the screen saver mode. Then, in step S170, determination is made whether the current user selected leaving a new message. If so, control continues to step S180. Otherwise, control jumps to step S190.

In step S180, the current user is allowed to leave a message, and the message is input and stored. In various exemplary embodiments of this invention, the message is stored in a specific memory different from a memory where user files and software can be stored. Control then returns to step S120.

In contrast, in step S190, a determination is made whether the current user is authorized to gain access to any messages that may have been left and to the normal mode. If so, control continues to step S200. Otherwise, control returns to step S150.

In step S200, each message that has been left is displayed, in turn. Control then returns to step S110.

Figure 4A:
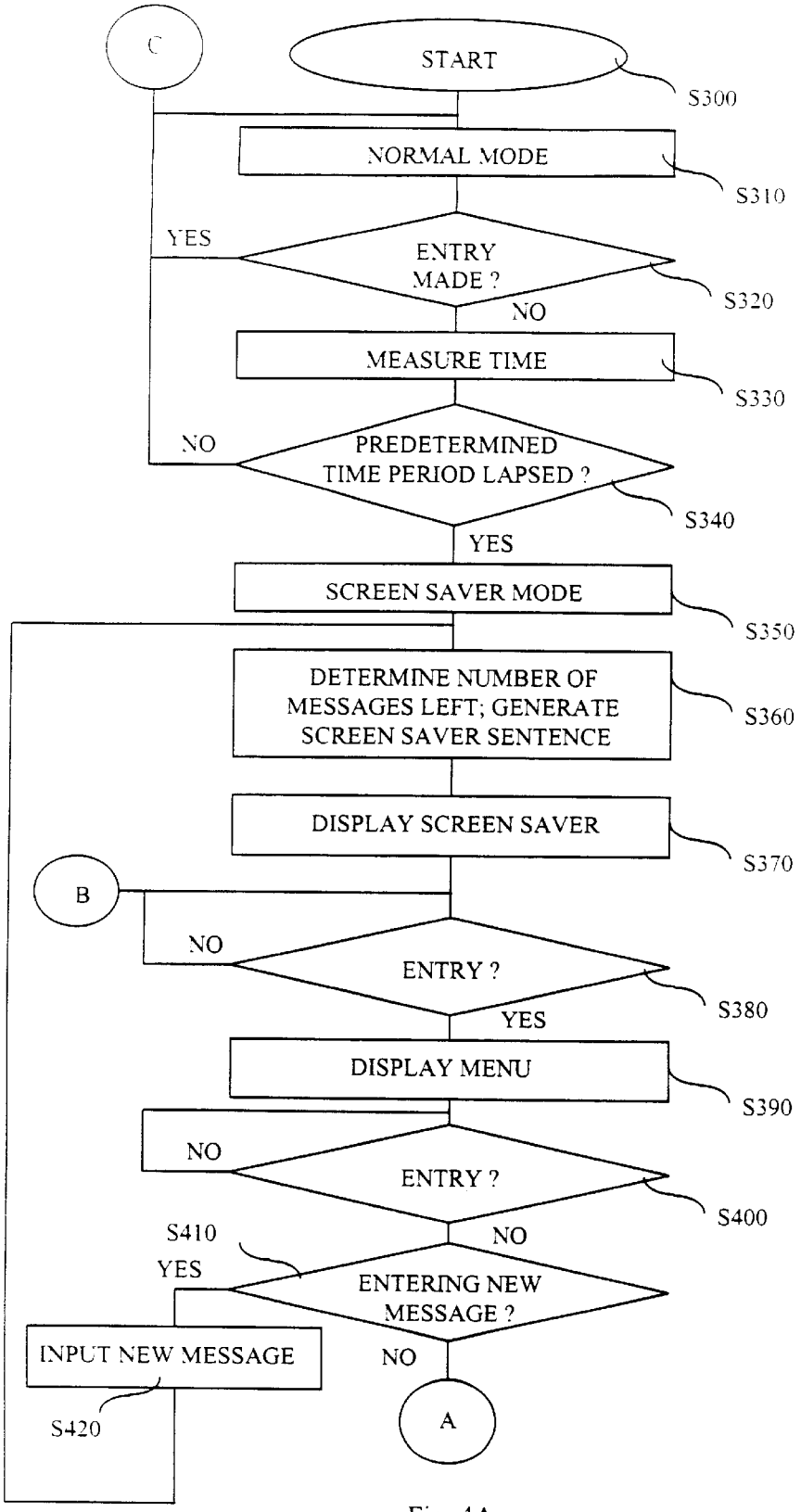
FIGS. 4A and 4B are a flowchart outlining a second exemplary embodiment of the data processing methods according to this invention.
Figure 4B:
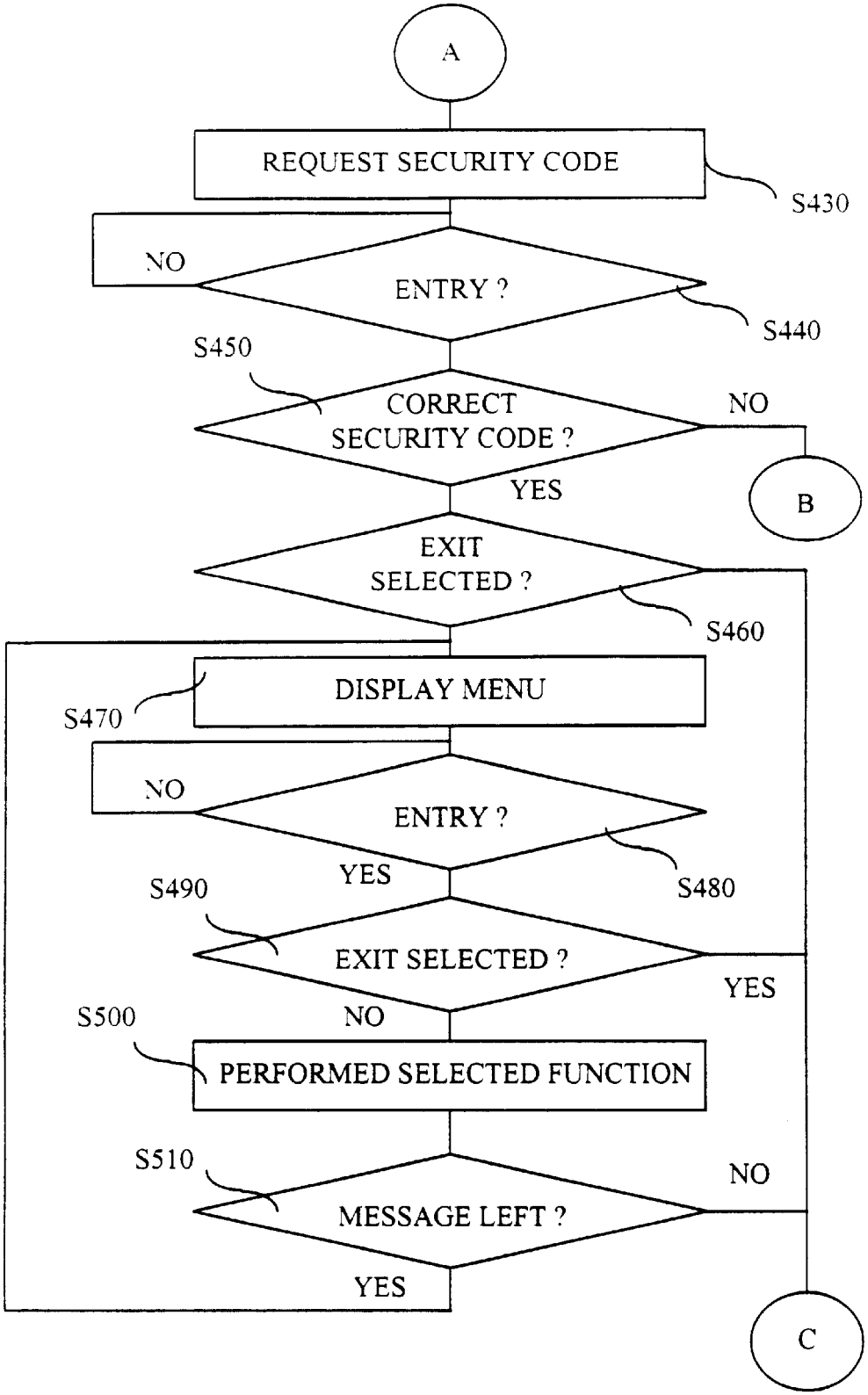

FIGS. 4A and 4B are a flowchart outlining a second exemplary embodiment of the data processing methods according to this invention. Beginning in step S300, control continues to step S310, where the data processing system is placed into a normal operating mode in which the user can gain access to all the available functions of the data processing system. Next, in step S320, a determination is made whether an input to the data processing system has been received by the data processing system. If so, control returns to step S310. Otherwise, control continues to step S330. In step S330, an elapsed time period since the last received input is measured. Then, in step S340, a determination is made whether the time period since the last input exceeds a predetermined period of time. If so, control continues to step S350. Otherwise, control returns to step S310.

In step S350, the data processing system is place into a screen saver mode. Next, in step S360, a number of messages left in the screen saver mode is determined, and a moving picture, including information relating to the number of messages left, is generated. Then, in step S370, the generated moving picture is displayed. Next, in step S380, a determination is made whether an entry has been made. If so, control continues to step S390. Otherwise, control returns to step S380.

In step S390, a first menu is displayed. The first menu provides one or more control functions such as, for example, exiting the screen saver mode, entering a new message, and reading the left messages. Then, in step S400, a determination is made whether one of the displayed functions has been selected. If so, control continues to step S410. Otherwise, control returns to step S400.

In step S410, a determination is made whether entering a new message has been selected. If so, control continues to step S420. Otherwise, control jumps to step S430. In step S420, a new message is input and stored. In various exemplary embodiments of the data processing systems and methods of this invention, the message is stored in a specific memory different from a memory where the user files and software can be stored. Control then returns to step S360.

In contrast, in step S430, a request for the current user to enter a security code is displayed. Next, in step S440, a determination is made whether a security code has been entered. If so, control continues to step S450. Otherwise, control returns to step S440. In step S450, a determination is made whether the correct security code has been entered. If so, control continues to step S460. Otherwise, control returns to step S370. In step S460, a determination is made whether exiting the screen saver mode has been selected. If so, control jumps back to step S310. Otherwise, control continues to step S470.

In step S470, a message and a second menu are displayed. The message is, for example, the oldest remaining message. The displayed second menu provides one or more control functions, such as, for example, exiting the screen saver mode, deleting the displayed message, printing the displayed message, saving the displayed message and forwarding the displayed message. Next, in step S480, a determination is made whether one of the control functions has been selected. If so, control continues to step S490. Otherwise, control returns to step S480.

In step S490, a determination is made whether exiting the screen saver mode has been selected. If so, control jumps back to step S310. Otherwise, control continues to step S500.

In step S500, the selected control function is performed. If deleting the displayed message has been selected, the displayed message is deleted. If printing the displayed message is selected, the displayed message is printed. If saving the displayed message is selected, a request for user to select a directory and a name for the displayed message is displayed and, upon proper selection, the displayed message is save in the selected directory, with the selected name. If forwarding the displayed message is selected, a request for the user to select a destination to which the displayed message should be forwarded is displayed and upon proper selection, the displayed message is forwarded to the selected destination.

Next, in step S510, a determination is made whether any unread messages are left. If so, control returns to step S470. Otherwise, control jumps back to step S310.

Figure 5:
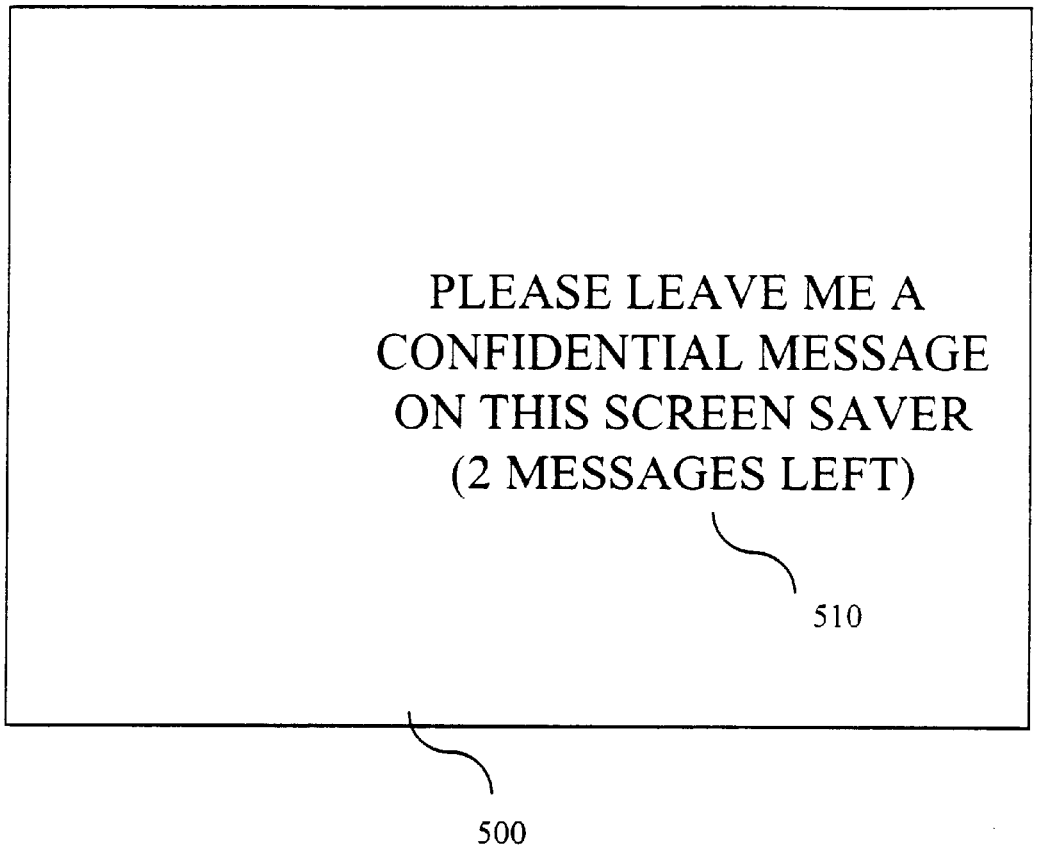
FIG. 5 is a schematic representation of a first exemplary image displayable using any one of the first-fourth exemplary embodiments of the data processing systems and methods according to this invention.

FIG. 5 is a schematic representation of a first exemplary image 500 displayable using any one of the first-fourth exemplary embodiments of the data processing systems and methods according to this invention described above with respect to FIG. 1–4. The image 500 is displayed at a moment a determination has been made that no input to the data processing system has been made through an input device for at least the predetermined amount of time. In the image 500, a message 510 moves slowly and continuously within the bounds of the display to save the screen components. In particular, the message 510 contains an indication that messages have been left for the user of the data processing system. More particularly, in the example shown in FIG. 5, the message 510 indicates that two messages have been left. However, in other exemplary embodiments according to the data processing systems and methods of this invention, any known or latter developed screen saver image can be displayed.

Figure 6:
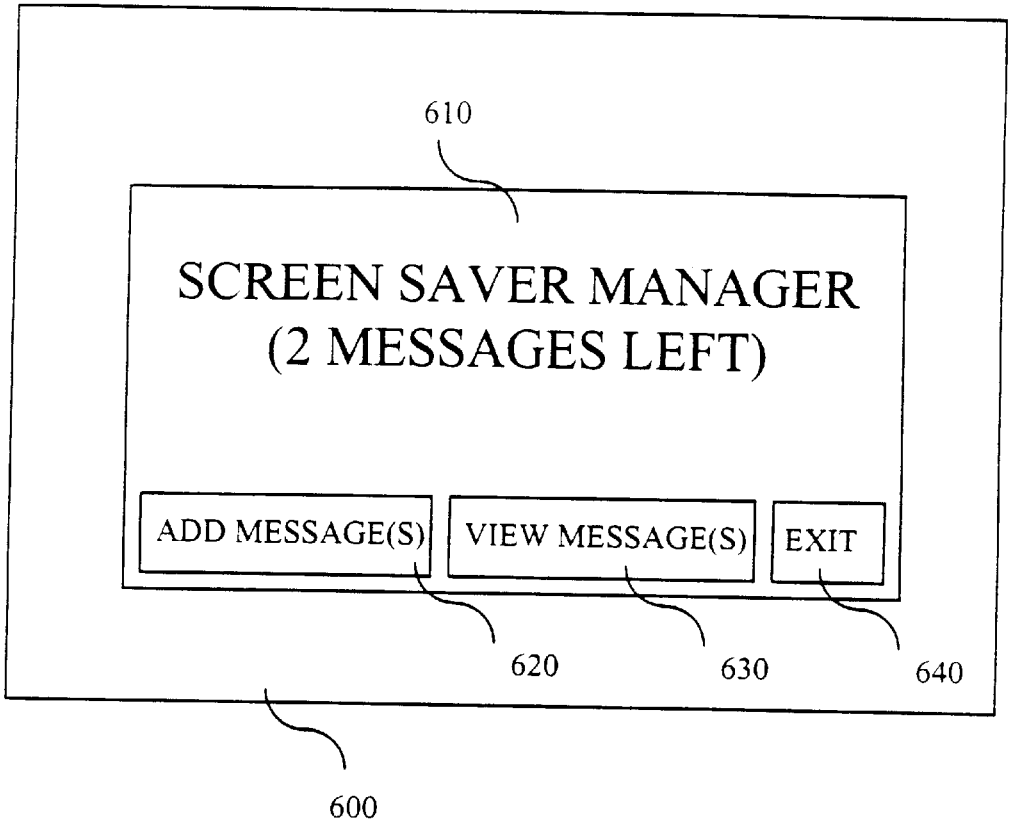
FIG. 6 is a schematic representation of a second exemplary image displayable using any one of the first-fourth exemplary embodiments of the data processing systems and methods according to this invention.

FIG. 6 is a schematic representation of a second exemplary image displayable using any one of the first-fourth exemplary embodiments of the data processing systems and methods according to this invention. The image 600 can be displayed after, or instead of, the image 500, upon a current user touching a mouse, typing on a key of a keyboard or generating some other input event in the data processing system. In response, the image 600, containing a main window 610 that includes a menu, is displayed. The menu provides the functions of adding a message, viewing one or more left messages or exiting the screen saver mode. The adding a message function is selected by selecting an add messages button 620. The adding a message function is intended to be chosen by visitors. The viewing left message (s) function is selected by selecting a view message button 630. The exiting function is selected by selecting an exiting button 640. The viewing left message(s) function and the exiting function are intended to be chosen by the authorized user of the computer system.

Figure 7:
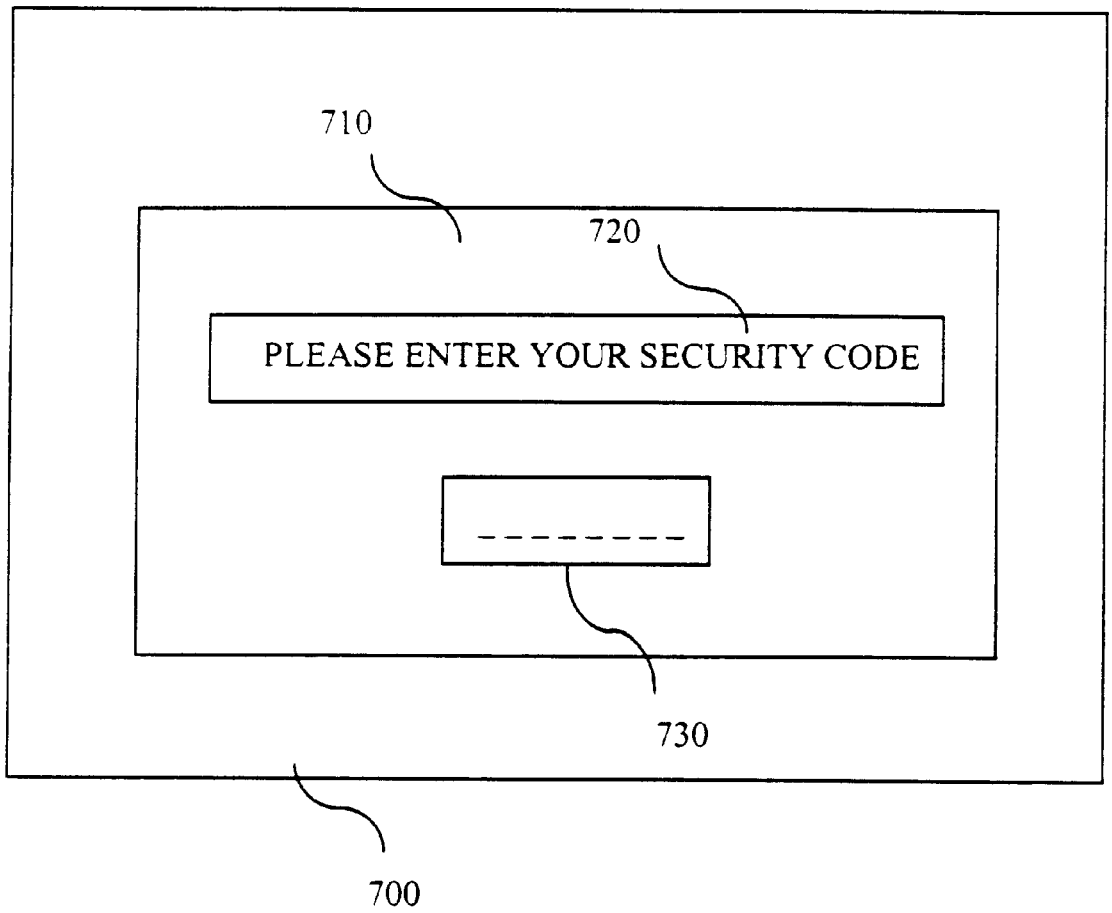
FIG. 7 is a schematic representation of an exemplary embodiment of a password graphical users interface displayable using any one of the first-fourth exemplary embodiments of the data processing systems and methods according to this invention.

FIG. 7 is a schematic representation of a third exemplary image 700 displayable using any one of the first-fourth exemplary embodiments of the data processing systems and methods according to this invention. The image 700 is displayed when one of the viewing message(s) function or the exiting function has been selected. In a main window 710, a message 720 invites the user to enter the user's security code by typing symbols into a window 730.

Figure 8:
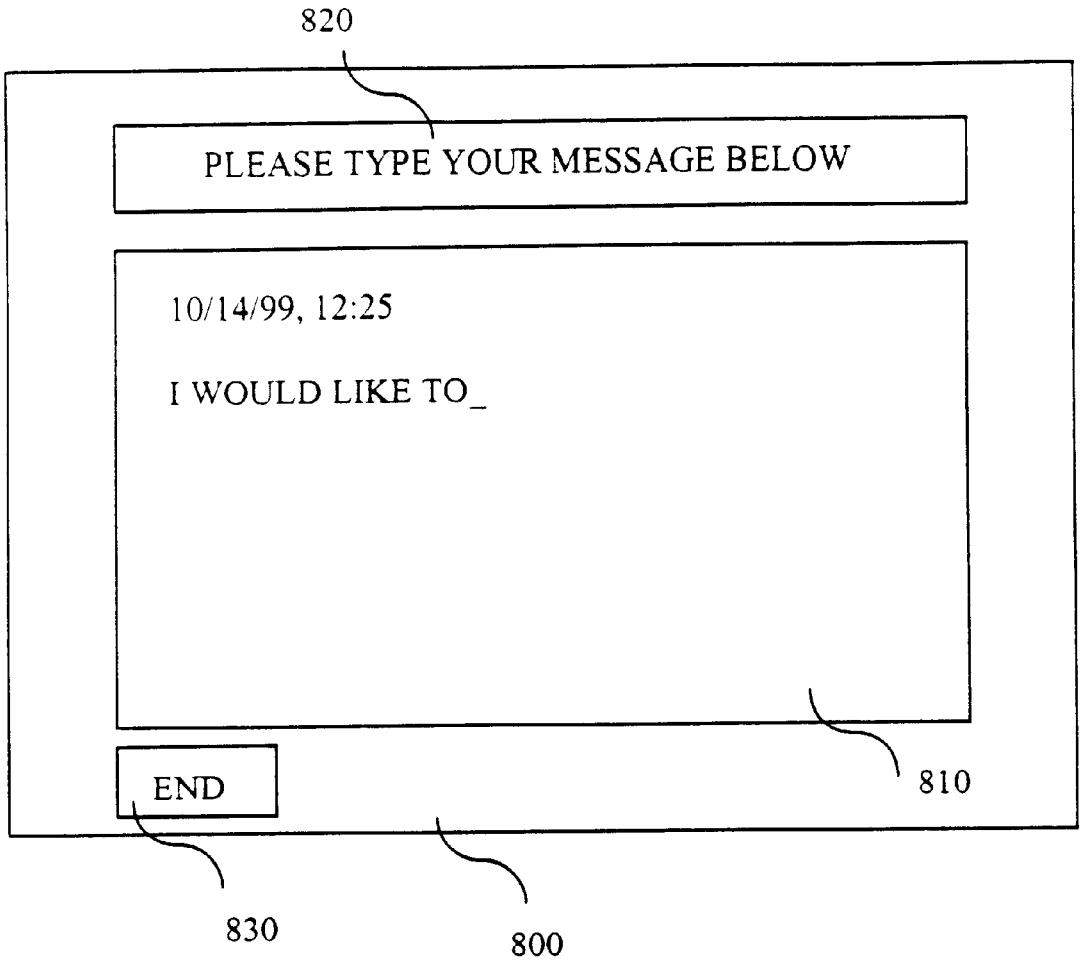
FIG. 8 is a schematic representation of an exemplary embodiment of a message entry graphical user interface displayable using any one of the first-fourth exemplary embodiments of the data processing systems and methods according to this invention.

FIG. 8 is a schematic representation of a fourth exemplary image 800 displayable using any one of the first-fourth exemplary embodiments of the data processing systems and methods according to this invention. The image 800 is displayed when the adding message(s) function has been selected. A message 820 invites the visitor to type a message in a window 810. The visited selects an end button 830 when the message is completed.

Figure 9:
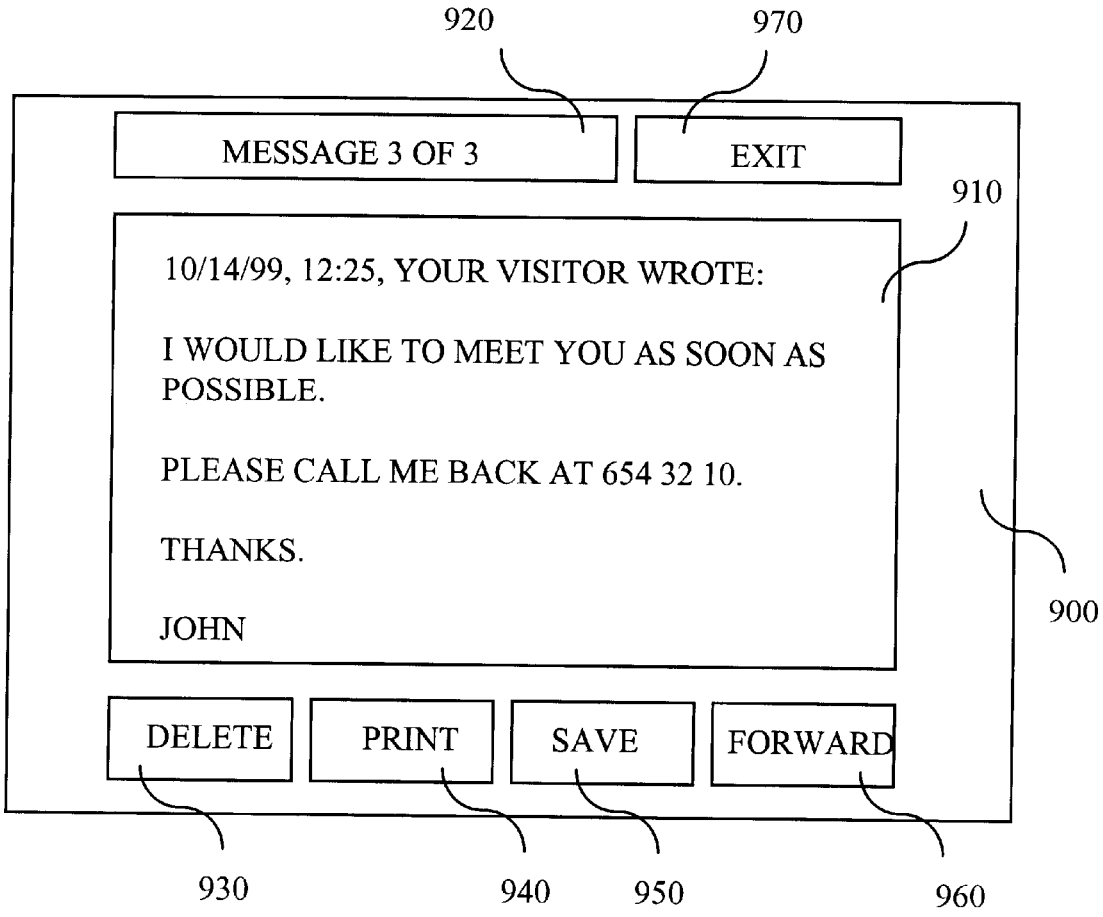
FIG. 9 is a schematic representation of an exemplary image displayable using any one of the first-fourth exemplary embodiments of the data processing systems and methods according to this invention.

FIG. 9 is a schematic representation of a fifth exemplary image 900 displayable using any one of the first-fourth exemplary embodiments of the data processing systems and methods according this invention. The image 900 is displayed when the security number entered by the user is recognized as corresponding to an authorized user. In a main window 910, a message is displayed. One message 920 indicates that the messages displayed in the main window 910 is the third one among three messages left. A delete button 930 allows the user to choose to delete the message displayed in the main window 910. A print button 940 allows the user to print the message displayed in the main window 910. A save button 950 allows the user to save the message into a non-volatile memory, such as, for example, a hard disk. A forward button 960 allows the user to forward the message to another processing system through a communication network, such as for example an intranet or the Internet. An exit button 970 allows the user to exit the screen saver mode.

Each of the data processing systems 100 and 200 can be implemented on a programmed general purpose computer. However, each of the data processing systems 100 or 200 can also be implemented ion a special purpose computer, a programmed microprocessor or microcontroller and peripheral integrated circuit elements, an ASIC or other integrated circuit, a digital signal processor, a hardwire electronic or logic circuit such as a discrete element circuit, a programmable logic device such as a PLD, PLA, FPGA or PAL, or the like. In general, any device capable of implementing a finite state machine that is in turn capable of implementing the flowcharts shown in FIGS. 3 or 4A–4B, and/or that is capable of generating, displaying and allowing user interaction with the graphical user interfaces shown in FIGS. 5–9, can be used to implement the data processing systems 100 or 200, respectively.

In the exemplary embodiment shown in FIG. 2, the non-volatile memory 290 is a hard disk. However, in other exemplary embodiments of the data processing systems according to this invention, the non-volatile memory can be any known or later developed storage device, such as a floppy disk and drive, a hard disk and drive, a writeable CD-ROM or DVD disk and drive, flash memory, or the like. It should also be appreciated that the non-volatile memory can be located locally to display or can be located remotely from the display.

Each of the links between the data processing systems 100 and 200 and the displays, input circuits, mouse, keyboard and printer can be any known or later developed device or system for connecting a data processing system to a peripheral or a network, including a direct cable connection, a connection over a wide area network or a local area network, a connection over an intranet, a connection over the Internet, or a connection over any other distributed processing network or system. Further, it should be appreciated that any of these links can be a wired or wireless link. The network 255 can be a wide area network or a local area network, an intranet, the Internet or any other distributed processing network or system.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method of managing messages on a data processing system, comprising:

determining if a predetermined time period has elapsed; and displaying a screen saver if the predetermined time period has elapsed;

wherein, while the screen saver is displayed, the method further comprises:

receiving at least one message at the data processing system;

determining if a user is allowed to review the at least one received message; and displaying at least one of the at least one received message only if it is determined that the user is allowed to review the at least one received message, comprising displaying, after determining that the user is allowed to review the at least one received message, the at least one displayed received message while the screen saver is displayed.

2. The method of claim 1, further including exiting the screen saver if it is determined that a user is allowed to review the at least one received message.

3. The method of claim 1, wherein displaying a screen saver comprises displaying information relating to a number of messages already received.

4. The method of claim 3, wherein displaying a screen saver comprises displaying the number of messages already received.

5. The method of claim 1, wherein displaying a screen saver comprises displaying a graphic user interface, the graphic user interface including a leaving message function and a viewing received messages function.

6. The method of claim 1, wherein displaying a screen saver comprises displaying a graphic user interface, the graphic user interface including a deleting message function.

7. The method of claim 1, wherein displaying a screen saver comprises displaying a graphic user interface, the graphic user interface including a printing message function.

8. The method of claim 1, wherein displaying a screen saver comprises displaying a graphic user interface, the graphic user interface including a forwarding message function.

9. The method of claim 1, wherein displaying a screen saver comprises displaying a graphic user interface, the graphic user interface including a saving message function.

10. An apparatus for managing messages, comprising:

a processing circuit that determines if a predetermined time period has elapsed; and a display manager that displays a screen saver if the processing circuit determines that the predetermined time period has elapsed;

wherein, while displaying the screen saver, the display manager allows at least one message to be received by the apparatus if the predetermined time period has elapsed, determines if a user is allowed to review at least one received message, and displays at least one received message only if the user is allowed to review at least one received message, the display manager displaying, after determining that the user is allowed to review the at least one received message, the at least one displayed received message while continuing to display the screen saver.

11. A screen saver comprising a graphic user interface, the graphic user interface including:

a leaving message function;

a viewing received message function; and an access authentification function;

wherein, while the screen saver is being displayed, any user can leave a message using the leave message function, but a user can use the view received message function only upon being authorized by using the access authentification function.

* * * * *